US007837089B2

(12) United States Patent
Pacheco

(10) Patent No.: US 7,837,089 B2
(45) Date of Patent: Nov. 23, 2010

(54) BULK MATERIAL BOX

(75) Inventor: Lee James Pacheco, North Aurora, IL (US)

(73) Assignee: International Paper, Memphis, TN (US)

( * ) Notice: Subject to any disclaimer, the term of this patent is extended or adjusted under 35 U.S.C. 154(b) by 302 days.

(21) Appl. No.: 12/156,034

(22) Filed: May 29, 2008

(65) Prior Publication Data

US 2009/0294519 A1 Dec. 3, 2009

(51) Int. Cl.
*B65D 5/32* (2006.01)

(52) U.S. Cl. ..... 229/122.23; 229/122.34; 229/143; 229/157; 229/198.2; 229/223

(58) Field of Classification Search ..... 229/122.23, 229/122.24, 122.26, 122.34, 132, 136, 198.2, 229/223, 143, 243, 244, 157
See application file for complete search history.

(56) References Cited

U.S. PATENT DOCUMENTS 1,546,601 A * 7/1925 Morris ..... 229/157
2,708,545 A * 5/1955 Seith ..... 229/123.1
2,727,675 A * 12/1955 Mairs et al. ..... 229/122.24
3,197,110 A * 7/1965 Neuman et al. ..... 229/244
3,281,049 A * 10/1966 Avitable et al. ..... 206/599
3,586,233 A * 6/1971 McCulloch ..... 229/143
3,819,107 A 6/1974 Ryder, Jr.
3,921,893 A * 11/1975 Randle, Jr. ..... 229/120.03
4,053,098 A 10/1977 Baptist
4,275,828 A * 6/1981 De Franco ..... 229/122.21
4,793,494 A 12/1988 Gordon, Jr.
4,869,398 A 9/1989 Colvin et al.
5,183,152 A 2/1993 Zak et al.
5,323,588 A 6/1994 Zak et al.
D348,607 S 7/1994 Young
5,390,790 A * 2/1995 Straub et al. ..... 229/109
5,419,485 A 5/1995 Petriekis et al.
5,555,996 A 9/1996 Lang-Ree et al.
5,562,246 A 10/1996 Smith et al.
5,975,413 A 11/1999 Moen
6,168,074 B1 * 1/2001 Petriekis et al. ..... 229/122.24
6,220,508 B1 4/2001 Wisser
6,223,981 B1 5/2001 Gunder
6,364,200 B1 * 4/2002 Moss et al. ..... 229/157
6,688,514 B2 2/2004 Evans et al.
6,968,992 B2 11/2005 Schuster
7,278,565 B2 10/2007 West
7,350,670 B2 4/2008 Steeves et al.
7,377,420 B2 * 5/2008 Gardner ..... 229/122.23

(Continued)

*Primary Examiner*—Gary E Elkins
(74) *Attorney, Agent, or Firm*—Thomas W. Barnes, III; Thomas W. Ryan, III

(57) ABSTRACT

A box includes an outer shell surrounding an inner sleeve having spaced apart first and second sleeve side walls attached to a sleeve bottom wall. A split sleeve top wall spaced apart from sleeve bottom wall defines spaced apart first and second open ends therebetween. Split sleeve top wall includes first and second sleeve sections separated by a sleeve split. Outer shell includes first and second shell side walls attached to a shell bottom wall and covering first and second open ends of inner sleeve. A shell top wall spaced apart from shell bottom wall includes first and second shell sections separated by a shell split substantially perpendicular to sleeve split. Flanges extend from shell top and bottom walls and first and second shell side walls along and bonded to outside surfaces of the sleeve side walls. The shell and sleeve are constructed from shell and sleeve blanks respectively.

24 Claims, 7 Drawing Sheets

U.S. PATENT DOCUMENTS

2003/0168503 A1 9/2003 Collura
2003/0234284 A1* 12/2003 Chiera ..... 229/120.011
2007/0102497 A1* 5/2007 Borek et al. ..... 229/122.24
2008/0023359 A1 1/2008 Churvis et al.

* cited by examiner

BULK MATERIAL BOX

BACKGROUND OF THE INVENTION

1. Field of the Invention

The present invention relates generally to bulk material boxes and, more specifically, to reinforced corrugated flatboard boxes for shipping and storing bags with material such as premixed drywall joint compound also referred to as mud used for drywall installation.

2. Description of Related Art

Moist or wet compounds such as mud used for drywall installations are often shipped in small volumes such as three to five gallon portions. These small volumes of compound are packaged in a plastic bag and housed within a paperboard container or box to protect the bag from puncture or compression and to facilitate the shipping, storage, and use of the compound. The box and bag may be opened, reopened and the mud removed in smaller quantities and often at different periods in time. The box includes flaps that open and close to provide access to the mud in the bag.

Boxes that have been specially designed to enclose and transport these bags usually are six sided boxes folded from one or more sheets or blanks made of corrugated paper having flaps that folded and glued together. The boxes usually have bottom and top walls that are formed from the overlap of major and minor flaps, and the box is usually constructed from blanks that fold flat for storage and shipment.

Reinforcing flanges have been used to add considerable structural support to the box. Tops of the box often have flaps that open up and away from the four sides of the box to allow opening the plastic bag and accessing the mud inside the bag. The bag may be folded back over an edge or perimeter of the box to further facilitate the removal of portions of the mud.

It is desirable to have boxes with sufficient structural support for stacking and shipping of the box and its contents during warehousing and distribution and still provide good access to the bag and its contents. It is desirable to have boxes constructed so they can be stacked in different orientations and have structural stability. It is desirable to have a box that allows for repeatable opening and closing of the bag and its contents and retain its structural integrity after the box has first been opened and compound material removed from the plastic bag. It is desirable to have a box that has few parts so that it is easy to store ship and assemble. It is desirable to produce a stronger and more cost effective box for shipping compound filled bags that has greater stacking strength than boxes presently being used so that the boxes may be stacked for shipping and storage and display.

BRIEF SUMMARY OF THE INVENTION

A box includes an outer shell surrounding an inner sleeve. The outer shell and the inner sleeve may both be rectangular. The inner sleeve includes spaced apart first and second sleeve side walls attached to a sleeve bottom wall and a split sleeve top wall spaced apart from the sleeve bottom wall and spaced apart first and second open ends defined therebetween. The split sleeve top wall includes first and second sleeve sections separated by a sleeve split. The outer shell includes spaced apart first and second shell side walls attached to a shell bottom wall and a split shell top wall spaced apart from the shell bottom wall. The split shell top wall includes first and second shell sections separated by a shell split that may be substantially perpendicular to the sleeve split. The first and second shell side walls cover the first and second open ends of the inner sleeve.

Bottom flanges extend from the shell bottom wall along and are bonded to outside surfaces of the first and second sleeve side walls. First and second flanges extend from the first and second shell side walls respectively along and are bonded to the outside surfaces of the first and second sleeve side walls respectively. Top flanges extend from the shell top wall along and are bonded to the outside surfaces of the first and second sleeve side walls.

An exemplary embodiment of the box further includes perforations disposed along edges between the shell top wall and the top flanges. The perforations partially outline first and second door panels of the first and second shell sections respectively. A lock for locking at least one of the first and second door panels to the split sleeve top wall. More particularly, the locks is used to lock at least one of the first and second door panels to the to first and second receptacles in the first and second sleeve sections respectively of the split sleeve top wall. Two locks may be used to lock both of the first and second door panels to the first and second receptacles in the first and second sleeve sections of the split sleeve top wall. The first and second receptacles include first and second cutouts in the first and second sleeve sections respectively of the split sleeve top wall. First and second ears on the locking tab are operable for disposal through the first and second cutouts and beneath the first and second sleeve sections respectively.

Miters are disposed between adjacent ones of the first and second flanges, the bottom flanges, and the top flanges. The shorter ones of the flanges have flared corners along the miters. A handle opening is provided in each of the first and second shell side walls.

The box is assembled from a box assembly having two blanks, an outer shell blank and an inner sleeve blank. An exemplary embodiment of the outer shell blank includes in longitudinal serial order a shell top first panel, a shell first side panel, a shell bottom panel, a shell second side panel, and a shell top second panel. Transversely extending and longitudinally spaced apart shell fold lines are disposed between the shell panels.

A transversely spaced apart pair of first flange flaps extend transversely away from the shell top first panel, a transversely spaced apart pair of second flange flaps extend transversely away from the shell top second panel, a transversely spaced apart pair of third flange flaps extend transversely away from the shell first side panel, a transversely spaced apart pair of fourth flange flaps extend transversely away from the shell second side panel, and a transversely spaced apart pair of fifth flange flaps extend transversely away from the shell bottom panel. All the flaps have equal transverse widths. The third and fourth flange flaps have rectangular sections with longitudinal widths equal to or less than the transverse widths of all the flaps.

A locking tab is disposed in each of the shell top first and second panels and has transversely spaced apart first and second ears on the locking tab. Chamfers on fifth flange outer corners of the fifth flange flaps and on first flange outer corners of the first flange flaps face the third flange flaps. Chamfers on second flange outer corners of the second flange flaps face the fourth flange flaps. Gussets are disposed in inner corners of the third and fourth flange flaps. Gusset faces of the gussets have gusset lengths and gusset angles equal in size to chamfer lengths and chamfer angles of chamfer faces of the chamfers. Handle openings are positioned on the shell first and second side panels.

An exemplary embodiment of the inner sleeve blank includes in longitudinal serial order a sleeve top wall first section panel, a sleeve first side wall panel, a sleeve bottom wall panel, a sleeve second side wall panel, and a sleeve top wall second section panel. Longitudinally spaced apart and transversely extending sleeve panel fold lines are disposed between the sleeve panels. Longitudinally spaced apart notches extend transversely inwardly from longitudinally spaced apart first and second outer edges of the sleeve top wall first and second section panels respectively.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

In accordance with the usual conventions regarding the illustration of blanks of foldable material, unless otherwise expressly indicated, solid lines within the interior of a blank represent die cuts or apertures, and broken or dotted lines represent lines of weakness such as score lines (which serve as fold lines herein), perforations, or the like. Illustrated in FIGS. 1-4 is an exemplary embodiment of a box 10 designed for carrying bulk material boxes and, more specifically, for shipping and storing bags with material such as premixed drywall joint compound also referred to as mud) used for drywall installation. The box 10 includes an outer shell 12 surrounding an inner sleeve 14. The box is illustrated herein as being rectangular as are its component outer shell and inner sleeve. Other polygonal shapes are contemplated, such as octagonal, for either one of both of the outer shell and inner sleeve.

Figure 1:
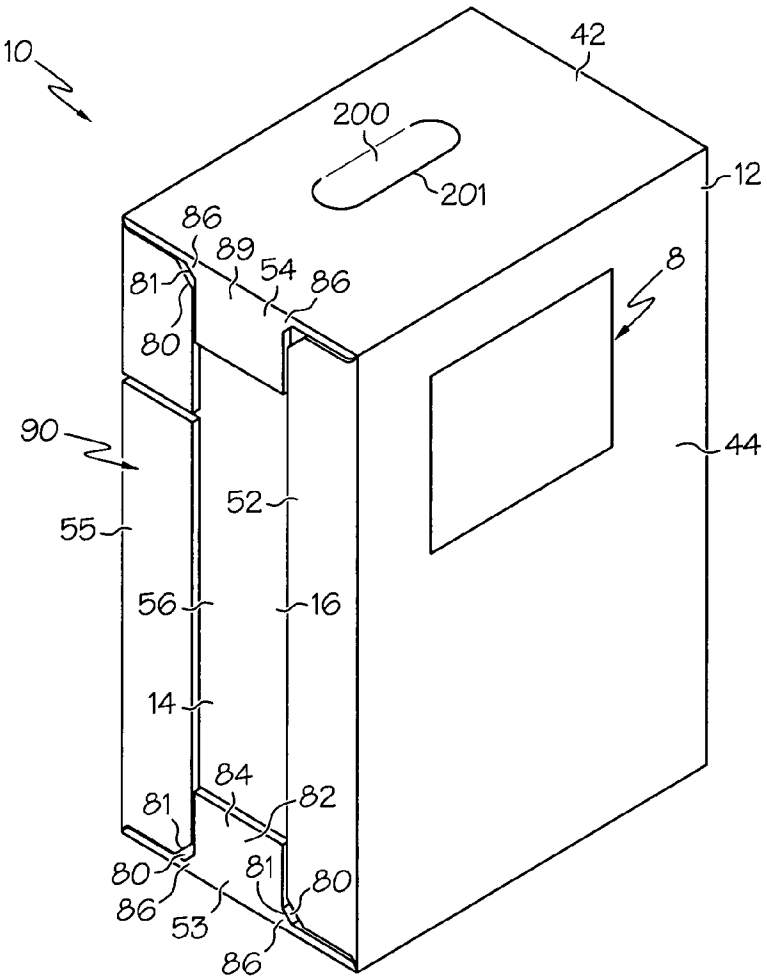
FIG. 1 is a perspective view illustration of a closed bulk material box standing on an end and having a rectangular outer shell surrounding a rectangular inner sleeve.
Figure 2:
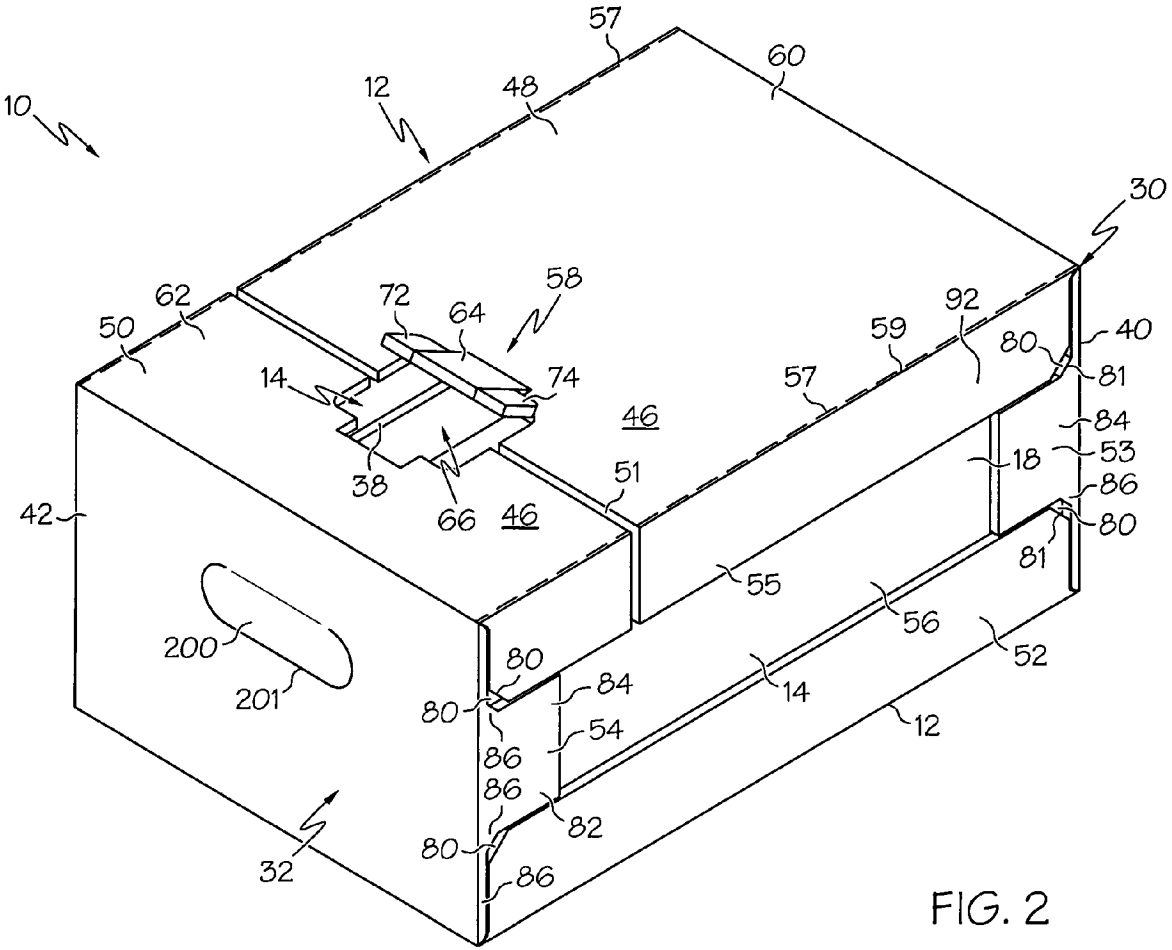
FIG. 2 is a perspective view illustration of the box illustrated in FIG. 1 standing on its bottom.
Figure 3:
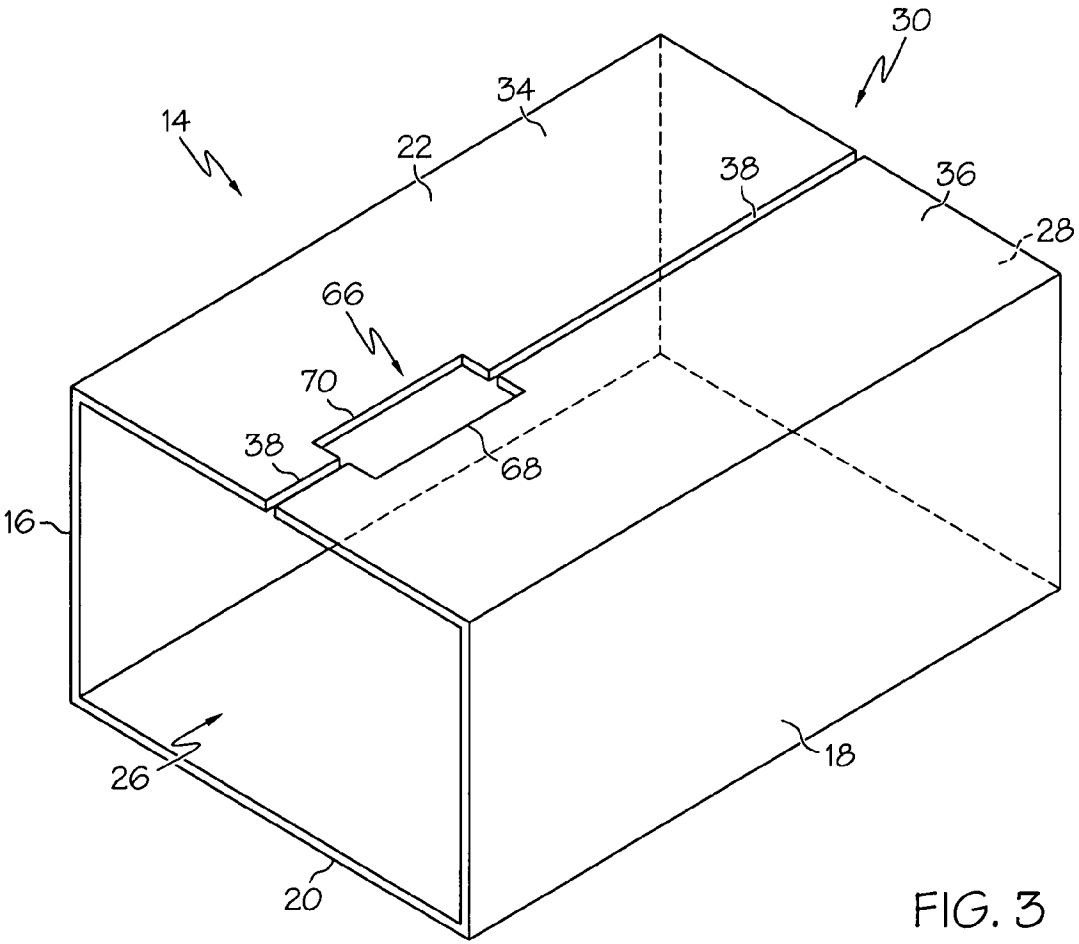
FIG. 3 is a perspective view illustration of the inner sleeve of the box illustrated in FIG. 1.
Figure 4:
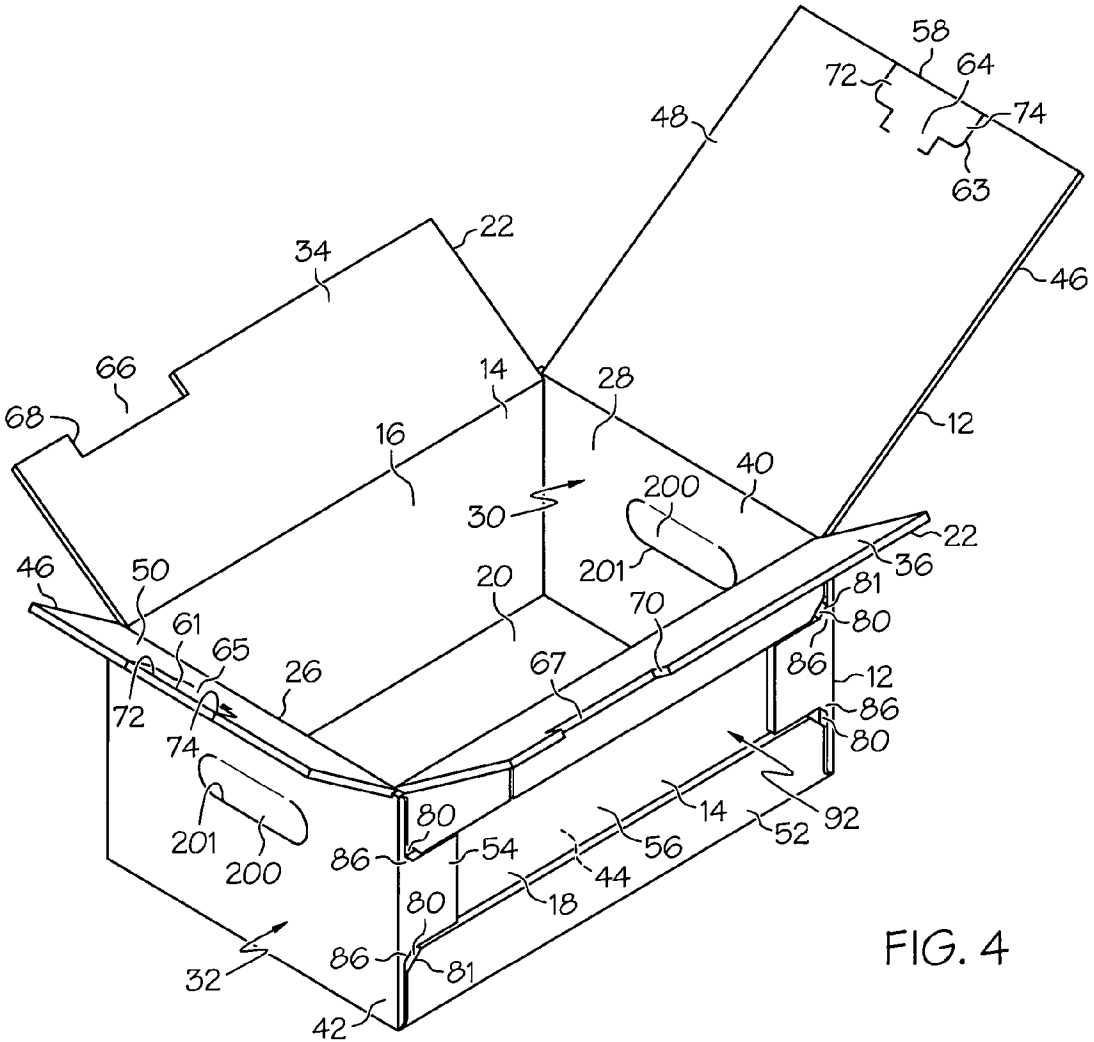
FIG. 4 is a perspective view illustration of the box illustrated in FIG. 1 in an open position.

Referring in particular to FIGS. 3 and 4, the inner sleeve 14 includes spaced apart first and second sleeve side walls 16, 18 attached to a sleeve bottom wall 20 and a split sleeve top wall 22 spaced apart from the sleeve bottom wall 20. Spaced apart first and second open ends 26, 28 are defined between the sleeve top wall 22 and the sleeve bottom wall 20 and the first and second sleeve side walls 16, 18. The split sleeve top wall 22 includes first and second sleeve sections 34, 36 separated by a sleeve split 38. Referring in particular to FIGS. 1, 2 and 4, the outer shell 12 includes longitudinally spaced apart first and second shell side walls 40, 42 attached to a shell bottom wall 44 and a split shell top wall 46 spaced apart from the shell bottom wall 44. The first and second shell side walls 40, 42 cover the first and second open ends 26, 28 of the sleeve 14 forming longitudinally spaced apart first and second box end walls 30, 32 respectively. The outer shell 12 further includes spaced apart first and second shell side walls 40, 42 attached to a shell bottom wall 44 and a split shell top wall 46 spaced apart from the shell bottom wall 44. The split shell top wall has first and second shell sections 48, 50 separated by a shell split 51 that is illustrated herein as being oriented substantially perpendicular to the sleeve split 38. The shell split 51 does not have to be oriented perpendicular to the sleeve split 38. The shell split 51 is illustrated as being located unevenly between the first and second shell side walls 40, 42. This design feature helps to accommodate and better counteract hydraulic pressure of the bulk material such as the premixed drywall joint compound stored within the box 10 and helps resist or prevent bulging of the side walls. The split 51 being located evenly between the first and second shell side walls 40, 42.

Bottom flanges 52 extend from the shell bottom wall 44 along and are bonded to outside surfaces 56 of the first and second sleeve side walls 16, 18. First and second flanges 53, 54 extend from the first and second shell side walls 40, 42 respectively along and are bonded to the outside surfaces 56 of the first and second sleeve side walls 16, 18. Top flanges 55 extend from the shell top wall 46 along and are bonded to the outside surfaces 56 of the first and second sleeve side walls 16, 18. The box includes transversely spaced apart first and second box side walls 90, 92. The flanges bonded to the first and second sleeve side walls 16, 18 form the first and second box side walls 90, 92 respectively.

The flanges strengthen the box so that it may be stacked on its side as illustrated in FIG. 1 allowing advertising 8 or other information to be prominently displayed. The flanges strengthen the box so that it may be stacked on its bottom as illustrated in FIG. 2 as well.

Referring in particular to FIG. 2, lines of weakness such as perforations 57 are disposed along edges 59 between and separate the first and second shell sections 48, 50 of the shell top wall 46 and the top flanges 55 that are bonded to the outside surfaces 56 of the first and second sleeve side walls 16, 18. The lines of weakness such as the perforations 57 partially outline first and second door panels 60, 62 of the first and second shell sections 48, 50 respectively and function to allow partial separation of the first and second door panels 60, 62 from the first and second shell sections 48, 50 respectively while remaining hinged with respect to the first and second shell side walls 40, 42. The edges 59 are designed to be cut along the perforations 57 to form the first and second door panels 60, 62 that are free to be opened and closed while remaining hinged to the first and second shell side walls 40, 42 respectively. Note that the perforations 57 are but one type of a line of weakness along which the first and second door panels 60, 62 are separable from the top flanges 55 by tearing or cutting or such.

First and second locks 58, 61 (illustrated in FIG. 4) are provided for locking the first and second door panels 60, 62 respectively. The first and second locks 58, 61 are illustrated herein as being operable to lock the first and second door panels 60, 62 to the split sleeve top wall 22 of the inner sleeve 14. Referring further to FIG. 4, the first and second locks 58, 61 include partially die cut first and second locking tabs 64, 65. The first and locking tabs 64, 65, when separated along locking tab die cut lines 63, are operable to lock or secure the first and second door panels 60, 62 respectively to first and second receptacles 66, 67 in the first and second sleeve sections 34, 36 of the split sleeve top wall 22. The first and second receptacles 66, 67 include first and second cutouts 68, 70 in the first and second sleeve sections 34, 36 of the split sleeve top wall 22. First and second ears 72, 74 on the first and second locking tabs 64, 65 are operable for being disposed through the first and second cutouts 68, 70 and beneath the first and second sleeve sections 34, 36 respectively to secure the first and second door panels 60, 62 to close the door panels and secure them to the first and second sleeve sections 34, 36.

Referring to FIGS. 1, 2, and 4, miters 80 are formed in flange corners 81 between adjacent ones 82 of the flanges. Miters 80 are formed in the flange corners 81 between the bottom flanges 52 and the first and second flanges 53, 54 and in the flange corners 81 between the top flanges 55 and the first and second flanges 53, 54. Shorter ones 84 of the flanges have flared corners 86 along the miters 80. As illustrated herein, the first and second flanges 53, 54 are the shorter flanges and, thus, have the flared corners 86. Handle openings 200 positioned on the first and second shell side walls 40, 42 allow the box 10 to be easily handled, carried and moved. The handle openings 200 are formed in part by die cut lines 201 in the first and second shell side walls 40, 42.

Figure 5:
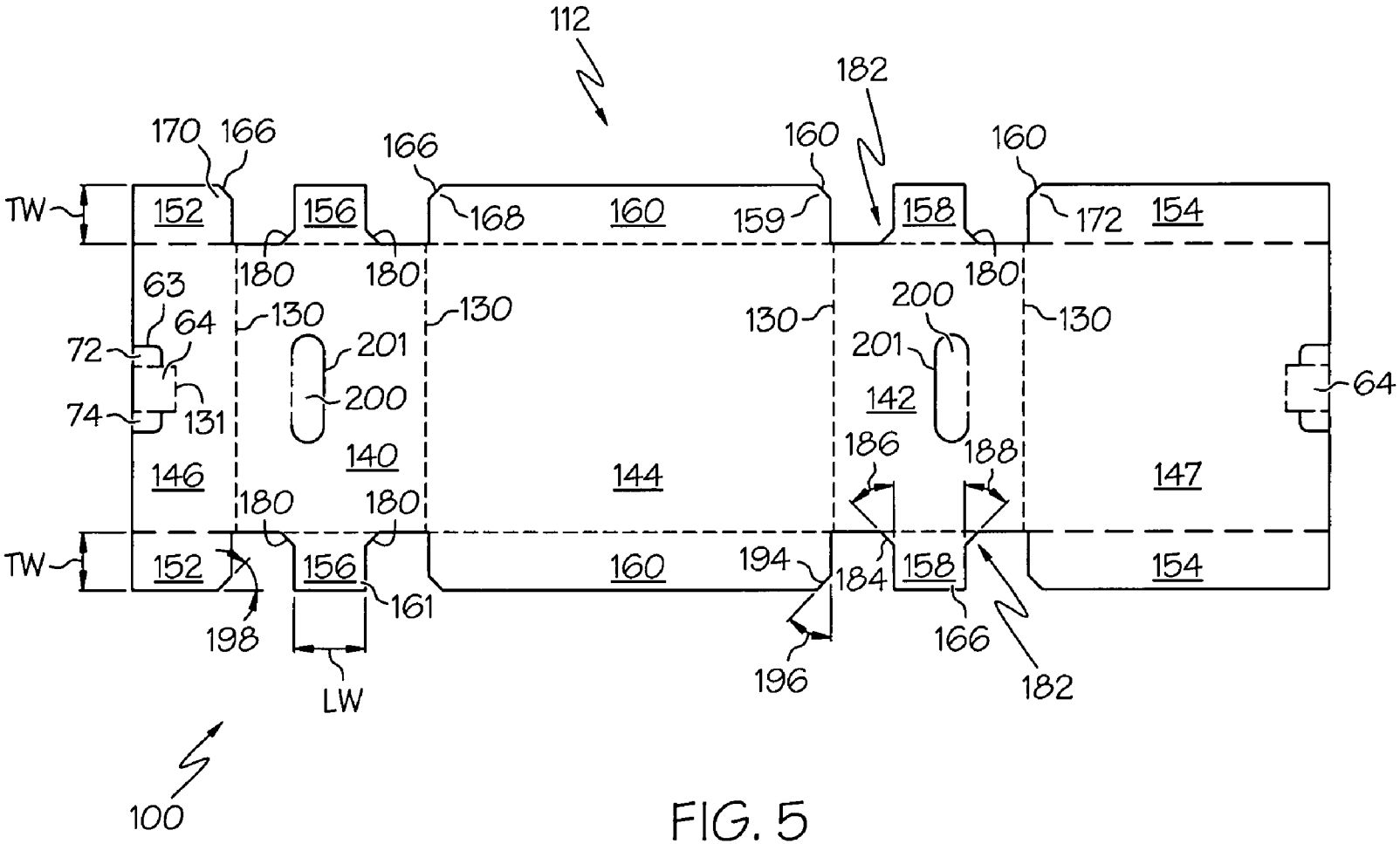
FIG. 5 is a plan view illustration of a shell blank for the outer shell of the box illustrated in FIG. 1.
Figure 6:
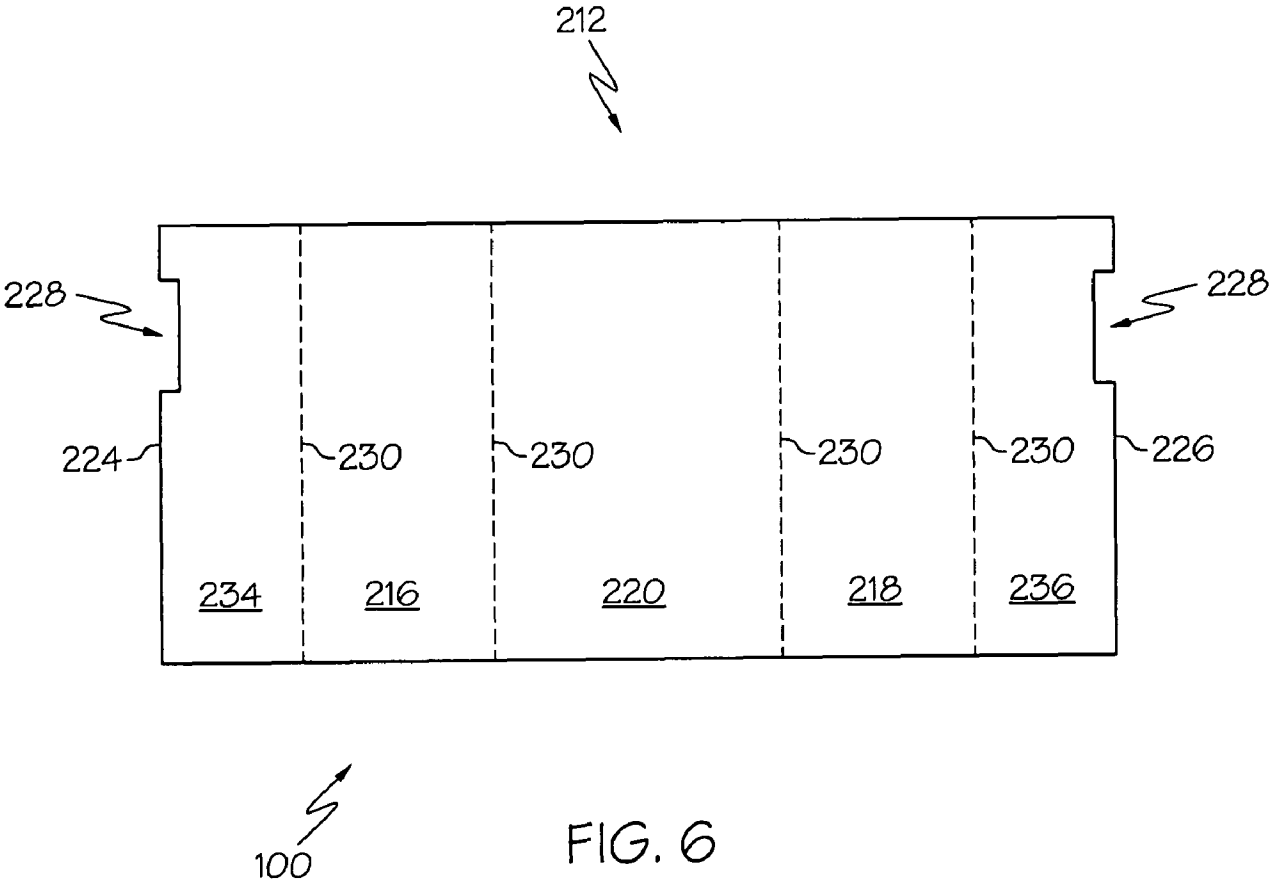
FIG. 6 is a plan view illustration of a sleeve blank for the inner sleeve of the box illustrated in FIG. 3.

The exemplary embodiment of the rectangular box 10 illustrated herein is designed to be constructed from an outer shell blank 112 corresponding to the outer shell 12 and an inner sleeve blank 212 corresponding to the sleeve 14 which together provide a box assembly 100 as illustrated in FIGS. 5 and 6. The outer shell blank 112 includes in longitudinal serial order a shell top first panel 146, a shell first side panel 140, a shell bottom panel 144, a shell second side panel 142, and a shell top second panel 147. Longitudinally spaced apart and transversely extending shell fold lines 130 are disposed between the shell panels to facilitate bending of the panels to form the outer shell of the box. A transversely spaced apart pair of first flange flaps 152 extend transversely away from the shell top first panel 146, a transversely spaced apart pair of second flange flaps 154 extend transversely away from the shell top second panel 147, a transversely spaced apart pair of third flange flaps 156 extend transversely away from the shell first side panel 140, a transversely spaced apart pair of fourth flange flaps 158 extend transversely away from the shell second side panel 142, and a transversely spaced apart pair of fifth flange flaps 160 extend transversely away from the shell bottom panel 144. All the flaps having equal transverse widths TW.

The third and fourth flange flaps 156, 158 have rectangular sections 161 with longitudinal widths LW equal to or less than the transverse widths TW of all the flaps. A locking tab 64 is provided in each of the shell top first and second panels 146, 147. The locking tab 64 illustrated herein includes transversely spaced apart first and second ears 72, 74 on the locking tab 64. The die cut lines 63 along a portion of the locking tab and of the ears allow them to be separated from the rest of the blank and hinge or rotate about a fold line 130.

Chamfers 166 are disposed on fifth flange outer corners 168 of the fifth flange flaps 160 and on first flange outer corners 170 of the first flange flaps 152 facing the third flange flaps 156. Chamfers 166 are also disposed on fifth flange outer corners 168 of the fifth flange flaps 160 and on second flange outer corners 172 of the second flange flaps 154 facing the fourth flange flaps 158. Gussets 180 are disposed in all inner corners 182 of the third and fourth flange flaps 156, 158 and include gusset faces 184. The gusset faces 184 have gusset lengths 186 and gusset angles 188 equal in size to chamfer lengths 196 and chamfer angles 198 of chamfer faces 194 of the chamfers 166. The chamfers 166 and the gussets 180 form the miters 80 in the flange corners of the box 10. Handle openings 200 positioned on the shell first and second side panels 140, 142 provide for the box 10 to be easily handled, carried and moved.

The inner sleeve blank 212 includes in longitudinal serial order a sleeve top wall first section panel 234, a sleeve first side wall panel 216, a sleeve bottom wall panel 220, a sleeve second side wall panel 218, and a sleeve top wall second section panel 236. Longitudinally spaced apart and transversely extending sleeve panel fold lines 230 are disposed between the sleeve panels to facilitate folding of the panels to form the inner sleeve. Longitudinally spaced apart notches 228 extend transversely inwardly from longitudinally spaced apart first and second outer edges 224, 226 of the sleeve top wall first and second section panels 234, 236 respectively. The notches 228 are illustrated as being rectangular in shape and are positioned and sized to cooperate with the locking tab 64 and in the more particular embodiment of the box 10 illustrated herein to cooperate with the first and second ears 72, 74 on the locking tab 64 to secure the first and second door panels 60, 62 to the first and second sleeve sections 34, 36.

Figure 7:
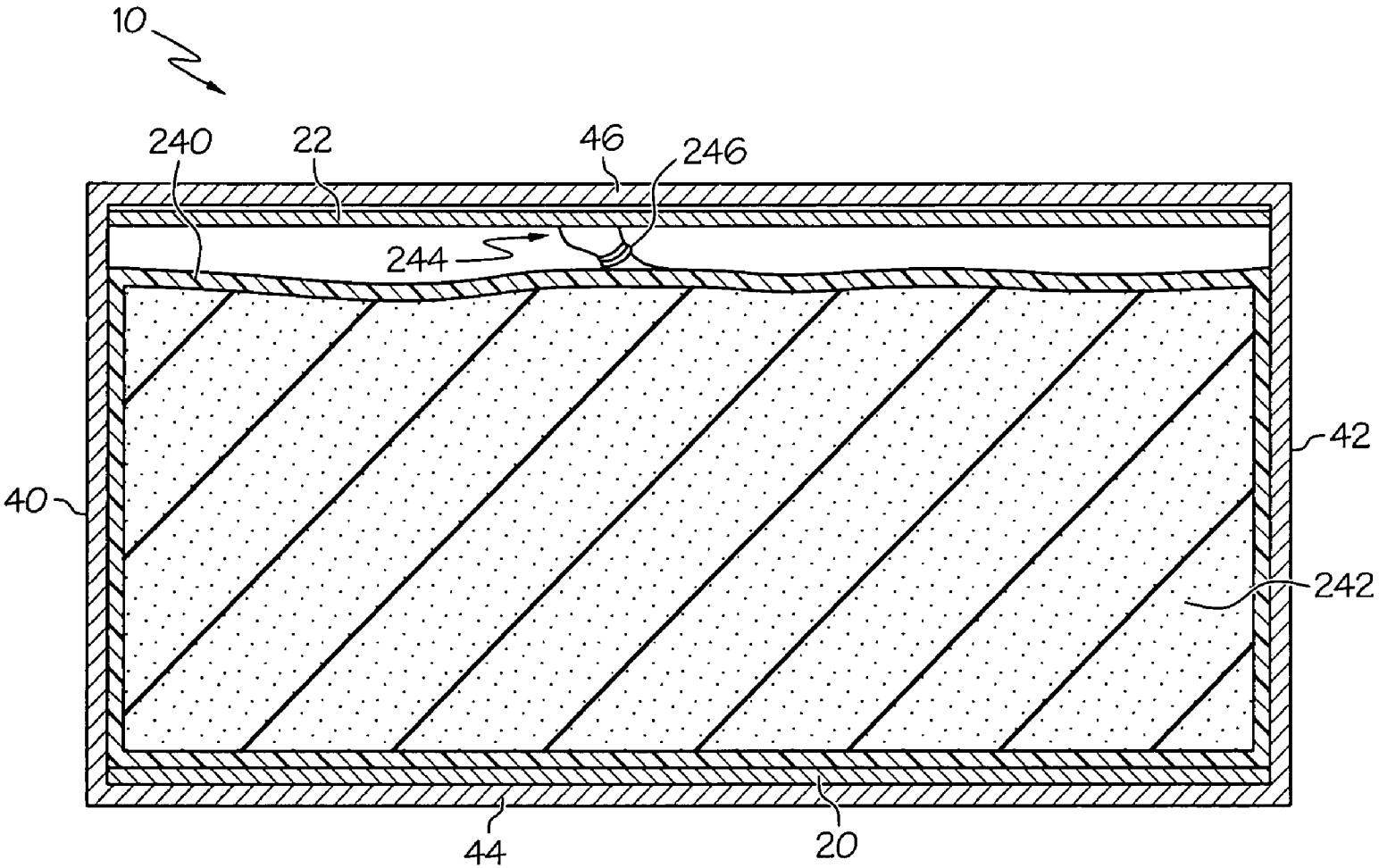
FIG. 7 illustrates a cross sectional view of a plastic bag containing the contents within the box.

FIG. 7 illustrates a flexible plastic bag 240 or covering surrounding and containing a moist bulk material such as premixed drywall joint compound 242 in the box 10. An open end 244 of the plastic bag is tied off and sealed with a tie 246, thus, preventing the moist compound or other moist bulk material from drying out. The tie may also be used to close such a bag or sheet of plastic containing a dry material such as a powdered substance such as dry joint compound or a granular material.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

The invention claimed is:

1. A box comprising:

an outer shell surrounding an inner sleeve, the inner sleeve including spaced apart first and second sleeve side walls attached to a sleeve bottom wall and a split sleeve top wall spaced apart from the sleeve bottom wall, spaced apart first and second open ends defined between the sleeve top wall and the sleeve bottom wall and the first and second sleeve side walls, the split sleeve top wall including first and second sleeve sections separated by a sleeve split, the outer shell including spaced apart first and second shell side walls attached to a shell bottom wall and a split shell top wall spaced apart from the shell bottom wall, the split shell top wall including first and second shell sections separated by a shell split, the first and second shell side walls covering the first and second open ends of the inner sleeve, bottom flanges extending from the shell bottom wall along and bonded to outside surfaces of the first and second sleeve side walls, first and second flanges extending from the first and second shell side walls respectively along and bonded to the outside surfaces of the first and second sleeve side walls respectively, top flanges extending from the shell top wall along and bonded to the outside surfaces of the first and second sleeve side walls, lines of weakness between the shell top wall and the top flanges, the lines of weakness partially outlining first and second door panels of the first and second shell sections respectively for partially separating the first and second door panels from the first and second shell sections respectively, the first and second door panels being hinged with respect to the first and second shell side walls (40, 42) respectively, and a lock for locking at least one of the first and second door panels, the lock being operable to lock at least one of the first and second door panels to the split sleeve top wall.

2. A box as claimed in claim 1 further comprising the shell split being substantially perpendicular to the sleeve split.

3. A box as claimed in claim 1 further comprising the lines of weakness including perforations along edges between the shell top wall and the top flanges.

4. A box as claimed in claim 1 further comprising the lock including a locking tab operable to lock at least one of the first and second door panels to first and second receptacles in the first and second sleeve sections respectively of the split sleeve top wall.

5. A box as claimed in claim 4 further comprising: the first and second receptacles including first and second cutouts in the first and second sleeve sections respectively of the split sleeve top wall, first and second ears on the locking tab, and the first and second ears being operable for disposal through the first and second cutouts and beneath the first and second sleeve sections respectively.

6. A box as claimed in claim 5 further comprising miters between adjacent ones of the first and second flanges, the bottom flanges, and the top flanges.

7. A box as claimed in claim 6 further comprising shorter ones of the flanges having flared corners along the miters.

8. A rectangular box comprising:

a rectangular outer shell surrounding a rectangular inner sleeve, the rectangular inner sleeve including spaced apart first and second sleeve side walls attached to a sleeve bottom wall and a split sleeve top wall spaced apart from the sleeve bottom wall, spaced apart first and second open ends defined between the sleeve top wall and the sleeve bottom wall and the first and second sleeve side walls, the split sleeve top wall including first and second sleeve sections separated by a sleeve split, the outer shell including spaced apart first and second shell side walls attached to a shell bottom wall and a split shell top wall spaced apart from the shell bottom wall, the split shell top wall including first and second shell sections separated by a shell split substantially perpendicular to the sleeve split, the first and second shell side walls covering the first and second open ends of the inner sleeve, bottom flanges extending from the shell bottom wall along and bonded to outside surfaces of the first and second sleeve side walls, first and second flanges extending from the first and second shell side walls respectively along and bonded to the outside surfaces of the first and second sleeve side walls respectively, top flanges extending from the shell top wall along and bonded to the outside surfaces of the first and second sleeve side walls, lines of weakness between the shell top wall and the top flanges, the lines of weakness having and partially outlining first and second door panels of the first and second shell sections respectively for partially separating the first and second door panels from the first and second shell sections respectively, the first and second door panels being hinged with respect to the first and second shell side walls (40, 42) respectively, and a lock for locking the first and second door panels to the split sleeve top wall.

9. A rectangular box as claimed in claim 8 further comprising the lock including first and second locking tabs operable to lock the first and second door panels respectively to first and second receptacles in the first and second sleeve sections respectively of the split sleeve top wall.

10. A rectangular box as claimed in claim 9 further comprising:

the first and second receptacles including first and second cutouts in the first and second sleeve sections respectively of the split sleeve top wall, first and second ears on each of the first and second locking tabs, and the first and second ears being operable for disposal through the first and second cutouts and beneath the first and second sleeve sections respectively.

11. A rectangular box as claimed in claim 10 further comprising a handle opening in each of the first and second shell side walls.

12. A rectangular box as claimed in claim 11 further comprising miters between adjacent ones of the of the first and second flanges, the bottom flanges, and the top flanges.

13. A rectangular box as claimed in claim 12 further comprising the first and second flanges, having flared corners along the miters.

14. At least one blank for forming a box assembly comprising:

an outer shell blank having in longitudinal serial order a shell top first panel, a shell first side panel, a shell bottom panel, a shell second side panel, a shell top second panel, and longitudinally spaced apart and transversely extending shell fold lines between the shell panels, a transversely spaced apart pair of first flange flaps extending transversely away from the shell top first panel, a transversely spaced apart pair of second flange flaps extending transversely away from the shell top second panel, a transversely spaced apart pair of third flange flaps extending transversely away from the shell first side panel, a transversely spaced apart pair of fourth flange flaps extending transversely away from the shell second side panel, the third and fourth flange flaps having rectangular sections with longitudinal widths equal to or less than the transverse widths of all the flaps, a transversely spaced apart pair of fifth flange flaps extending transversely away from the shell bottom panel, all the flaps having equal transverse widths, and a locking tab in each of the shell top first and second panels.

15. At least one blank as claimed in claim 14 further comprising transversely spaced apart first and second ears on each of the locking tabs.

16. At least one blank as claimed in claim 15 further comprising:

chamfers on fifth flange outer corners of the fifth flange flaps and on first flange outer corners of the first flange flaps facing the third flange flaps and on second flange outer corners of the second flange flaps facing the fourth flange flaps, gussets in inner corners of the third and fourth flange flaps, and gusset faces of the gussets having gusset lengths and gusset angles equal in size to chamfer lengths and chamfer angles of chamfer faces of the chamfers.

17. At least one blank as claimed in claim 16 further comprising handle openings positioned on the shell first and second side panels.

18. At least one blank as claimed in claim 14 further comprising:

an inner sleeve blank including in longitudinal serial order a sleeve top wall first section panel, a sleeve first side wall panel, a sleeve bottom wall panel, a sleeve second side wall panel, and a sleeve top wall second section panel; and longitudinally spaced apart and transversely extending sleeve panel fold lines between the sleeve panels.

19. At least one blank as claimed in claim 18 further comprising longitudinally spaced apart notches extending transversely inwardly from longitudinally spaced apart first and second outer edges of the sleeve top wall first and second section panels respectively.

20. At least one blank as claimed in claim 19 further comprising the third and fourth flange flaps having rectangular sections with longitudinal widths equal to or less than the transverse widths of all the flaps.

21. At least one blank as claimed in claim 20 further comprising a locking tab in each of the shell top first and second panels.

22. At least one blank as claimed in claim 21 further comprising transversely spaced apart first and second ears on the locking tab.

23. At least one blank as claimed in claim 21 further comprising:

chamfers on fifth flange outer corners of the fifth flange flaps and on first flange outer corners of the first flange flaps facing the third flange flaps and on second flange outer corners of the second flange flaps facing the fourth flange flaps, gussets in all inner corners of the third and fourth flange flaps, and gusset faces of the gussets having gusset lengths and gusset angles equal in size to chamfer lengths and chamfer angles of chamfer faces of the chamfers.

24. At least one blank as claimed in claim 23 further comprising handle openings positioned on the shell first and second side panels.

* * * * *